US010395879B2

(12) United States Patent
Yamamoto et al.

(10) Patent No.: US 10,395,879 B2
(45) Date of Patent: Aug. 27, 2019

(54) TUNGSTEN ALLOY PART, AND DISCHARGE LAMP, TRANSMITTING TUBE, AND MAGNETRON USING THE SAME

(71) Applicants: Kabushiki Kaisha Toshiba, Tokyo (JP); Toshiba Materials Co., Ltd., Yokohama (JP)

(72) Inventors: Shinichi Yamamoto, Fujisawa (JP); Kayo Nakano, Yokohama (JP); Hiromichi Horie, Yokosuka (JP)

(73) Assignees: Kabushiki Kaisha Toshiba, Minato-Ku (JP); Toshiba Materials Co., Ltd., Yokohama-Shi (JP)

( * ) Notice: Subject to any disclaimer, the term of this patent is extended or adjusted under 35 U.S.C. 154(b) by 660 days.

(21) Appl. No.: 14/554,264

(22) Filed: Nov. 26, 2014

(65) Prior Publication Data

US 2015/0125340 A1 May 7, 2015

Related U.S. Application Data

(63) Continuation of application No. PCT/JP2012/083318, filed on Dec. 21, 2012.

(30) Foreign Application Priority Data

May 29, 2012 (JP) ..... 2012-122511
Jul. 3, 2012 (JP) ..... 2012-150020

(51) Int. Cl.

| | |
|---|---|
| ***C22C 27/04*** | (2006.01) |
| ***H01J 1/144*** | (2006.01) |
| ***H01J 23/05*** | (2006.01) |
| ***H01J 61/073*** | (2006.01) |
| ***B22F 5/12*** | (2006.01) |
| ***C22C 1/04*** | (2006.01) |
| ***C22C 1/10*** | (2006.01) |
| ***C22C 32/00*** | (2006.01) |

(52) U.S. Cl.

CPC ..... *H01J 1/144* (2013.01); *B22F 5/12* (2013.01); *C22C 1/045* (2013.01); *C22C 1/1078* (2013.01); *C22C 27/04* (2013.01); *C22C 32/0052* (2013.01); *H01J 23/05* (2013.01); *H01J 61/0735* (2013.01); *H01J 2201/30449* (2013.01)

(58) Field of Classification Search

CPC ..... C22C 1/045; C22C 27/04; C22C 32/0052; H01J 61/0735

USPC ..... 420/431

See application file for complete search history.

(56) References Cited

U.S. PATENT DOCUMENTS 5,783,907 A * 7/1998 Suzuki ..... H01J 61/28 313/625
6,190,579 B1 2/2001 Billings
(Continued)

FOREIGN PATENT DOCUMENTS

CN 1288968 A 3/2001
CN 1865476 A 11/2006
(Continued)

OTHER PUBLICATIONS

NPL: English machine translation of CN 1865476A, Nov. 2006.*
(Continued)

*Primary Examiner* — Jie Yang
(74) *Attorney, Agent, or Firm* — Burr & Brown, PLLC

(57) ABSTRACT

According to one embodiment, a tungsten alloy includes 0.1 to 5 wt % of Zr in terms of ZrC.

5 Claims, 4 Drawing Sheets

(56) References Cited

U.S. PATENT DOCUMENTS

| | | | | |
|---|---|---|---|---|
| 6,764,620 | B1 * | 7/2004 | Palmisiano | C01B 32/956 264/29.1 |
| 8,324,918 | B2 * | 12/2012 | Wajata | C22C 32/0047 324/754.01 |
| 2004/0011739 | A1 | 1/2004 | Ozanne et al. | |
| 2005/0104521 | A1 | 5/2005 | Berndanner et al. | |
| 2006/0220559 | A1 | 10/2006 | Ikeuchi | |
| 2006/0266158 | A1 | 11/2006 | Shindo | |
| 2007/0172378 | A1 | 7/2007 | Shibuya et al. | |
| 2009/0128039 | A1 | 5/2009 | Wang et al. | |
| 2010/0194415 | A1 | 8/2010 | Wajata | |
| 2011/0243184 | A1 | 10/2011 | Nakabayashi et al. | |
| 2014/0301891 | A1 * | 10/2014 | Yamamoto | C22C 43/00 420/430 |

FOREIGN PATENT DOCUMENTS

| | | | |
|---|---|---|---|
| JP | 02-073944 | A1 | 3/1990 |
| JP | 2002-226935 | A1 | 8/2002 |
| JP | 2004-508462 | A1 | 3/2004 |
| JP | 2006-102775 | A1 | 4/2006 |
| JP | 2007-113104 | A1 | 5/2007 |
| JP | 2008-073712 | A1 | 4/2008 |
| JP | 2008-115063 | A1 | 5/2008 |
| JP | 2008-539332 | A1 | 11/2008 |
| JP | 2009-091651 | A1 | 4/2009 |
| JP | 2009-102670 | A1 | 5/2009 |
| JP | 4486163 | B1 | 6/2010 |
| JP | 2010-196172 | A1 | 9/2010 |
| JP | 2011-103240 | A1 | 5/2011 |
| JP | 4741190 | B2 | 8/2011 |
| WO | WO2005/073418 | A1 | 8/2005 |

OTHER PUBLICATIONS

NPL-1: Wang et al, Influence of ZrC content on the elevated temperature tensile properties of ZrCp/W component, Material Science and Engineering A 258 (2011), pp. 1805-1811.*

International Search Report and Written Opinion (Application No. PCT/JP2012/083318) dated Mar. 12, 2013.

International Preliminary Report on Patentability dated Dec. 11, 2014 (with English translation).

T. Suzuki, "*Carbide Relational Phase Diagram*," Journal of the Patent Institute of Metals and Materials, Japan, The Japan Institute of Metals and Materials, Jan. 1, 1996, vol. 5, No. 1, pp. 9-16.

Japanese Office Action (Application No. 2014-518225) dated Mar. 24, 2015.

Chinese Office Action (Application No. 201280060611.4) dated Jun. 3, 2015 (with English translation).

Chinese Office Action (Application No. 201280060611.4) dated Feb. 5, 2016 (with English translation).

M.J. Albert, et al., "A New Type of Composite All-Metal Electron Emitter for Valves and Electron-Optical Devices," *British Journal of Applied Physics*, vol. 18, No. 5, May 1, 1967, pp. 627-633.

L.V. Gorshkova, "Joint Solubility of Carbon and Zirconium in Molybdenum—Tungsten Solid Solutions," Test Methods and Properties of Materials, *Soviet Powder of Metallurgy and Metal Ceramics*, vol. 15, No. 3, Mar. 31, 1976, pp. 215-216.

Extended European Search Report (Application No. 12877876.8) dated Jan. 13, 2016.

* cited by examiner

TUNGSTEN ALLOY PART, AND DISCHARGE LAMP, TRANSMITTING TUBE, AND MAGNETRON USING THE SAME

CROSS-REFERENCE TO RELATED APPLICATIONS

This application is a Continuation application of PCT Application No. PCT/JP2012/083318, filed Dec. 21, 2012 and based upon and claiming the benefit of priority from Japanese Patent Application No. 2012-122511, filed May 29, 2012, and the Japanese Patent Application No. 2012-150020, filed Jul. 3, 2012, entire contents of all of which are incorporated herein by reference.

FIELD

An embodiment of the present invention relates to a tungsten alloy part, and a discharge lamp, a transmitting tube, and a magnetron using the same.

BACKGROUND

A tungsten alloy part which utilizes the high-temperature strength of tungsten is used in various fields. Examples thereof include a discharge lamp, a transmitting tube, and a magnetron. The tungsten alloy part is used for a cathode electrode, an electrode supporting rod, and a coil part or the like in the discharge lamp (HID lamp). The tungsten alloy part is used for a filament and a mesh grid or the like in the transmitting tube. The tungsten alloy part is used for the coil part or the like in the magnetron. These tungsten alloy parts include a sintered body having a predetermined shape, a wire rod, and a coil part obtained by processing the wire rod into a coil form.

Conventionally, as described in Jpn. Pat. Appln, KOKAI Publication No. 2002-226935 (Patent Literature 1), a tungsten alloy containing thorium (or a thorium compound) is used for these tungsten alloy parts. In the tungsten alloy of Patent Literature 1, deformation resistance is improved by finely dispersing thorium particles and thorium compound particles so that the average particle diameter thereof is set to 0.3 μm or less. Since the thorium-containing tungsten alloy has excellent emitter characteristics and mechanical strength at a high temperature, the thorium-containing tungsten alloy is used in the above fields.

However, since thorium or the thorium compound is a radioactive material, a tungsten alloy part using no thorium is desired in consideration of the influence on the environment. In Jpn. Pat. Appln. KOKAI Publication No. 2011-103240 (Patent Literature 2), a tungsten alloy part containing boride lanthanum ($LaB_6$) has been developed as the tungsten alloy part using no thorium.

On the other hand, a short arc type high-pressure discharge lamp using a tungsten alloy containing lanthanum trioxide ($La_2O_3$) and $HfO_2$ or $ZrO_2$ is described in Patent Literature 3. According to the tungsten alloy described in Patent Literature 3, sufficient emission characteristics are not obtained. This is because lanthanum trioxide has a low melting point of about 2300° C., and lanthanum trioxide is evaporated in an early stage when a part is subjected to a high temperature by increasing an applied voltage or a current density, which causes deterioration in emission characteristics.

CITATION LIST

Patent Literature

Patent Literature 1: Jpn. Pat. Appln. KOKAI Publication No. 2002-226935

Patent Literature 2: Jpn. Pat. Appln. KOKAI Publication No. 2011-103240

Patent Literature 3: Japanese Patent No. 4741190

DETAILED DESCRIPTION

Figure 1:
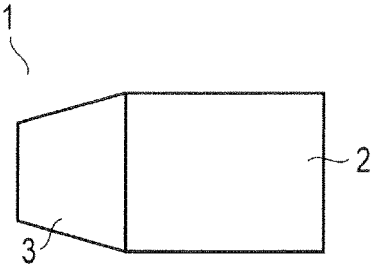
FIG. 1 shows an example of a discharge lamp electrode part of an embodiment.

For example, discharge lamps, parts of which use a tungsten alloy, are roughly divided into two kinds (a low-pressure discharge lamp and a high-pressure discharge lamp). Examples of the low-pressure discharge lamp include various arc-discharge type discharge lamps such as for general lighting, special lighting used for a road or a tunnel or the like, a curing apparatus for a coating material, a UV curing apparatus, a sterilizer, and a light cleaning apparatus for a semiconductor or the like. Examples of the high-pressure discharge lamp include a processing apparatus for water supply and sewerage, general lighting, outdoor lighting for a stadium or the like, a UV curing apparatus, an exposure device for a semiconductor and a printed circuit board or the like, a wafer inspection apparatus, a high-pressure mercury lamp such as a projector, a metal halide lamp, an extra high pressure mercury lamp, a xenon lamp, and a sodium lamp.

A voltage of 10 V or more is applied to the discharge lamp according to the application. When a voltage is less than 100 V, a life equal to that of the thorium-containing tungsten alloy is obtained for the tungsten alloy containing boride lanthanum described in Patent Literature 2. However, if the voltage is 100 V or more, the emission characteristics are deteriorated. As a result, the life is also largely decreased.

Similarly, there is a problem that sufficient characteristics are not obtained also for the transmitting tube or the magnetron if the applied voltage is increased.

It is an object of the present invention to provide a tungsten alloy part exhibiting characteristics equal to or higher in characteristics than those of a thorium-containing tungsten alloy part, without using thorium which is a radioactive material, and a discharge lamp, a transmitting tube, and a magnetron using the tungsten alloy part.

According to an embodiment, a tungsten alloy part containing tungsten and 0.1 to 5 wt % of Zr in terms of ZrC is provided. The tungsten alloy part preferably contains 0.1 to 3 wt % of Zr in terms of ZrC. The tungsten alloy part contains at least two kinds selected from the group consisting of Zr, ZrC, and C. When the contents of Zr, ZrC, and C are expressed in $ZrC_x$, $x<1$ is preferably set; $0<x<1$ is more preferably set; and $0.2<x<0.7$ is still more preferably set.

The tungsten alloy part may further contain 0.01 wt % or less of at least one element selected from the group consisting of K, Si, and Al. When the content of Zr is defined as 100 parts by mass, the tungsten alloy part may contain 10 parts by mass or less of Hf.

The primary particles of ZrC preferably have an average particle diameter of 15 μm or less, and more preferably have an average particle diameter of 5 μm or less and a maximum diameter of 15 μm or less. Secondary particles of ZrC preferably have a maximum diameter of 100 μm or less.

In the tungsten alloy part, at least a part of metal Zr is preferably formed a solid solution with tungsten. Metal Zr preferably exists on a surface of the tungsten alloy part. When the content of Zr is defined as 100 parts by mass, the content of Zr contained in ZrC is preferably 25 to 75 parts by mass.

The tungsten alloy part preferably has a wire diameter of 0.1 to 30 mm. The tungsten alloy part preferably has a Vickers hardness of Hv 330 or more, and particularly preferably 330 to 700.

The area ratio of tungsten crystals having a crystal particle diameter of 1 to 80 μm per unit area of a transverse section (radial section) of the tungsten alloy part is preferably 90% or more. The area ratio of tungsten crystals having a crystal particle diameter of 2 to 120 μm per unit area of a vertical section of the tungsten alloy part is preferably 90% or more.

The tungsten alloy part of the embodiment is used for a discharge lamp part, a transmitting tube part, or a magnetron part, for example.

A discharge lamp of an embodiment includes the tungsten alloy part of the embodiment. A transmitting tube of an embodiment includes the tungsten alloy part of the embodiment. A magnetron of an embodiment includes the tungsten alloy part of the embodiment.

When the tungsten alloy part of the embodiment is applied to an electrode of the discharge lamp, an applied voltage to the electrode is preferably 100 V or more. Since the tungsten alloy part of the embodiment included in the discharge lamp electrode does not contain neither thorium nor thorium oxide, the tungsten alloy part does not exert a bad influence on the environment. Both of thorium and thorium oxide are a radioactive material. In addition, the discharge lamp electrode including the tungsten alloy part of the embodiment has characteristics equal to or higher than those of an electrode containing a thorium-containing tungsten alloy. For this reason, the discharge lamp including the tungsten alloy part of the embodiment is environment-friendly.

A tungsten alloy part of an embodiment contains 0.1 to 5 wt % of Zr in terms of ZrC. The tungsten alloy part contains 0.1 to 5 wt % of Zr (zirconium) in terms of ZrC (zirconium carbide), and thereby characteristics such as emission characteristics and strength can be improved. When the content of Zr is less than 0.1 wt % in terms of ZrC, the addition effect of Zr is insufficient. When the content of Zr is more than 5 wt %, the characteristics are deteriorated. The content of Zr is preferably 0.5 to 2.5 wt % in terms of ZrC.

A tungsten alloy preferably contains at least two kinds of components selected from the group consisting of Zr, ZrC, and C. That is, the tungsten alloy contains a combination of Zr and ZrC, a combination of Zr and C (carbon), a combination of ZrC and C (carbon), or a combination of Zr, ZrC, and C (carbon), as the ZrC component. When the melting points are compared, the melting points of metal Zr, ZrC, and tungsten are respectively 1850° C., 3420° C., and 3400° C. (see Iwanami Shoten "Rikagakujiten (Dictionary of Physics and Chemistry)"). The melting points of metal thorium and thorium dioxide ($ThO_2$) are respectively 1750° C. and 3220±50° C. Since zirconium carbide has a melting point higher than that of thorium, the tungsten alloy part of the embodiment can have a strength at high-temperature equal to or higher than that of a thorium-containing tungsten alloy part.

When the contents of Zr, ZrC, and C (carbon) are expressed in $ZrC_x$, $x<1$ is preferably set. $x<1$ means that the ZrC component contained in the tungsten alloy does not wholly exist as stoichiometric ZrC, and a part thereof exist as metal Zr. Since the work function of ZrC is 3.3, and equal to the work function (3.4) of metal Th, the emission characteristics can be improved. Since zirconium carbide forms a solid solution with tungsten, zirconium carbide is a component effective in enhancing strength.

When the contents of Zr, ZrC, and C are expressed in $ZrC_x$, $0<x<1$ is preferably set. $x<1$ is described above. $0<x$ means that either ZrC or C exists in the tungsten alloy. ZrC or C has a deoxidation effect for removing an oxygen impurity contained in the tungsten alloy. Since the electrical resistance value of the tungsten alloy part can be decreased by reducing the oxygen impurity, the tungsten alloy part has improved characteristics as an electrode. When the contents of Zr, ZrC, and C are expressed in $ZrC_x$, $0.2<x<0.7$ is more preferably set. In this range, metal Zr, ZrC, or C exists in a good balance, to improve characteristics such as emission characteristics, strength, and electrical resistance.

The contents of Zr, ZrC, and C in the tungsten alloy part can be measured by using an ICP analysis method. In the ICP analysis method, an amount of Zr obtained by adding an amount of Zr of metal Zr and an amount of Zr of ZrC can be measured. Similarly, an amount of carbon obtained by adding an amount of carbon of ZrC, and an amount of carbon which independently exists or an amount of carbon which exists as another carbide can be measured. In the embodiment, the amount of Zr and the amount of C are measured by the ICP analysis method, and expressed in $ZrC_x$.

The tungsten alloy part of the embodiment may contain 0.01 wt % or less of at least one element selected from the group consisting of K, Si, and Al. K (potassium), Si (silicon), and Al (aluminum) are so-called dope materials. Recrystallization characteristics can be improved by adding these dope materials. The recrystallization characteristics are improved, and thereby a uniform recrystallized structure is likely to be obtained when a recrystallization heat treatment is performed. Although the lower limit of the content of the dope material is not particularly limited, the content of the dope material is preferably 0.001 wt % or more. When the content of the dope material is less than 0.001 wt %, the addition effect is small. When content of the dope material is more than 0.01 wt %, sinterability and processability are deteriorated, which may cause a decrease in a mass production property.

The tungsten alloy part of the embodiment may contain 10 parts by mass or less of Hf when the content of Zr is 100 parts by mass. The content of Zr represents the total amount of Zr in Zr and ZrC. Since Hf (hafnium) has a high melting point of 2207° C., Hf hardly exerts an adverse influence even when Hf is contained in the tungsten alloy part. Commercially available Zr powder may contain Hf of several percent depending on the grade. It is effective to use high-purity Zr powder or high-purity ZrC powder from which impurities have been removed in order to improve the characteristics. On the other hand, highly-purified raw material causes a cost increase. If the content of Hf (hafnium) is 10 parts by mass or less when the content of Zr is defined as 100 parts by weight, excessive deterioration of the characteristics can be prevented.

When the amount of carbon in a surface part in the tungsten alloy part of the embodiment is defined as C1 (wt %) and the amount of carbon in a central part is defined as C2 (wt %), C1<C2 is preferably set. The surface part means a portion located between the surface of the tungsten alloy part and a point distant by 20 μm from the surface. The central part is a central portion in the section of the tungsten alloy part. The amount of carbon is a value obtained by adding both carbon of a carbide such as ZrC, and independently existing carbon, and can be analyzed by the ICP analysis method. The amount of carbon C1 in the surface part<the amount of carbon C2 in the central part means that carbon in the surface part is oxidized into $CO_2$, which is discharged to the outside of the system. When the amount of carbon in the surface part is decreased, the amount of Zr in the surface part is relatively increased. For this reason, it is particularly effective when Zr is used as an emitter material.

The tungsten alloy part of the embodiment preferably contains tungsten crystals having an average crystal particle diameter of 1 to 100 μm. The tungsten alloy part is preferably a sintered body. When the tungsten alloy part is the sintered body, parts having various shapes can be prepared by utilizing a molding process. The sintered body is subjected to a forging process, a rolling process, and a wiredrawing process or the like, and thereby the sintered body is likely to be processed into a wire rod (including a filament) and a coil part or the like.

The tungsten crystals of the sintered body have an isotropic crystal structure in which the ratio of crystals having an aspect ratio of less than 3 is 90% or more. When the sintered body is subjected to the wiredrawing process, the tungsten crystals have a flat crystal structure in which the ratio of crystals having an aspect ratio of 3 or more is 90% or more. The particle diameters of the tungsten crystals can be obtained as follows. First, a photograph of a crystal structure is taken by a metallurgical microscope or the like. A virtual circle is drawn for one tungsten crystal existing in the section, and the diameter of the virtual circle is defined as a particle diameter. This measurement is performed for 100 arbitrary tungsten crystals, and the average value thereof is defined as an average crystal particle diameter.

When the average crystal particle diameter of the tungsten crystals is a small value of less than 1 μm, it is difficult to form a uniform dispersion state of a dispersed component such as Zr, ZrC, or C. This is because the grain boundary is small when the average crystal particle diameter of the tungsten crystals is a small value of less than 1 μm, which makes it difficult to uniformly disperse the dispersed component in the grain boundary between the tungsten crystals. On the other hand, when the average crystal particle diameter of the tungsten crystals is a large value of more than 100 μm, the strength as the sintered body is decreased. Therefore, the average crystal particle diameter of the tungsten crystals is preferably 1 to 100 μm, and more preferably 10 to 60 μm.

From the viewpoint of uniform dispersion, the average particle diameter of the dispersed component such as Zr, ZrC, or C is preferably smaller than the average crystal particle diameter of the tungsten crystals. Specifically, when the average particle diameter of tungsten is defined as A (μm) and the average particle diameter of the dispersed component is defined as B (μm), B/A≤0.5 is preferably set. The dispersed component such as Zr, ZrC, or C exists in the grain boundary between the tungsten crystals, and functions as an emitter material or a grain boundary reinforcing material. The average particle diameter of the dispersed component is decreased to ½ or less of the average crystal particle diameter of tungsten, and thereby the dispersed component are likely to be uniformly dispersed in the grain boundary between the tungsten crystals, which can reduce variation in the characteristics.

The above tungsten alloy part is preferably used for at least one kind of a discharge lamp part, a transmitting tube part, and a magnetron part.

Figure 2:
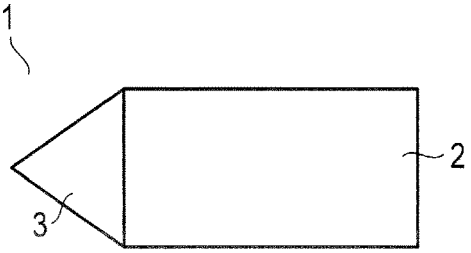
FIG. 2 shows another example of the discharge lamp electrode part of the embodiment.

Examples of the discharge lamp part include a cathode electrode, an electrode supporting rod, and a coil part which are used for a discharge lamp. FIGS. 1 and 2 show an example of a discharge lamp cathode electrode. In FIGS. 1 and 2, numeral number 1 designates a cathode electrode; numeral number 2 designates an electrode body part; and numeral number 3 designates an electrode tip part. The cathode electrode 1 is formed by the sintered body of the tungsten alloy. The electrode tip part 3 may have a tip having a truncated cone shape as shown in FIG. 1 or a tip having a cone shape as shown in FIG. 2. The tip part is subjected to polishing processing if needed. Preferably, the electrode body part 2 has a cylindrical shape, and has a diameter of 2 to 35 mm and a length of 10 to 300 mm.

Figure 3:
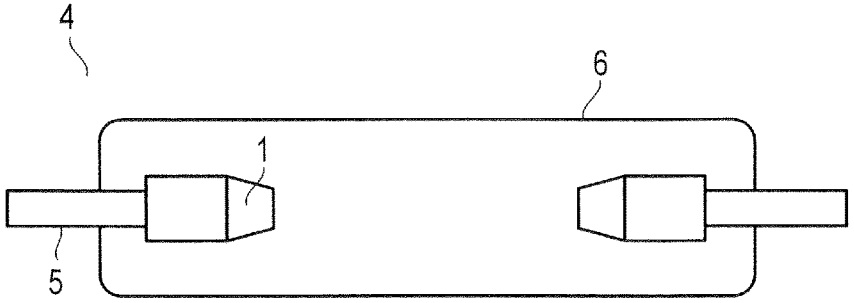
FIG. 3 shows an example of a discharge lamp of an embodiment.

FIG. 3 shows an example of the discharge lamp. In FIG. 3, numeral number 1 designates a cathode electrode; numeral number 4 designates a discharge lamp; numeral number 5 designates an electrode supporting rod; and numeral number 6 designates a glass tube. In the discharge lamp 4, the pair of cathode electrodes 1 are disposed in a state where electrode tip parts face each other. The cathode electrode 1 is joined to the electrode supporting rod 5. A phosphor layer which is not shown is provided on the inner surface of the glass tube 6. A mercury, halogen, or argon gas (or neon gas) or the like is enclosed in the glass tube 6 if needed. When the tungsten alloy part of the embodiment is used as the electrode supporting rod 5, the whole electrode supporting rod may be the tungsten alloy of the embodiment. The tungsten alloy of the embodiment may be used for a portion of the electrode supporting rod joined to the cathode electrode and the remaining portion may be formed of another lead material.

The coil part may be attached to the electrode supporting rod depending on the kind of the discharge lamp, to produce the electrode. The tungsten alloy of the embodiment can also be applied to the coil part.

The tungsten alloy part of the embodiment is used for the discharge lamp of the embodiment. The kind of the discharge lamp is not particularly limited. The discharge lamp can be applied to both a low-pressure discharge lamp and a high-pressure discharge lamp. Examples of the low-pressure discharge lamp include various arc-discharge type discharge lamps such as for general lighting, special lighting used for a road or a tunnel or the like, a curing apparatus for a coating material, a UV curing apparatus, a sterilizer, and a light cleaning apparatus for a semiconductor or the like. Examples of the high-pressure discharge lamp include a processing apparatus for water supply and sewerage, general lighting, outdoor lighting for a stadium or the like, a UV curing apparatus, an exposure device for a semiconductor and a printed circuit board or the like, a wafer inspection apparatus, a high-pressure mercury lamp such as a projector, a metal halide lamp, an extra high pressure mercury lamp, a xenon lamp, and a sodium lamp.

The tungsten alloy part of the embodiment is suitable also for the transmitting tube part. Examples of the transmitting tube part include a filament or a mesh grid. The mesh grid may be obtained by knitting a wire rod in a mesh form or forming a plurality of holes in a sintered body plate. Since the tungsten alloy part of the embodiment is used as the transmitting tube part in the transmitting tube of the embodiment, the transmitting tube has good emission characteristics or the like.

Figure 4:
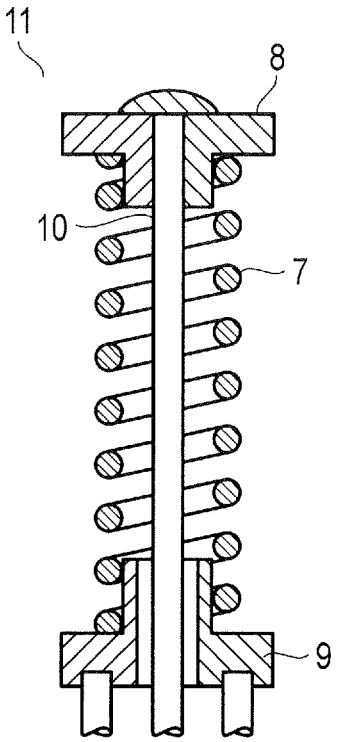
FIG. 4 shows an example of a magnetron part of an embodiment.

The tungsten alloy part of the embodiment is suitable also for the magnetron part. Examples of the magnetron part include a coil part. FIG. 4 shows a magnetron cathode structure as an example of the magnetron part. In FIG. 4, numeral number 7 designates a coil part; numeral number 8 designates an upper supporting member; numeral number 9 designates a lower supporting member; numeral number 10 designates a supporting rod; and numeral number 11 designates a magnetron cathode structure. The upper supporting member 8 and the lower supporting member 9 are integrated with each other with the supporting rod 10 provided therebetween. The coil part 7 is disposed around the supporting rod 10, and the supporting rod 10 is integrated with the upper supporting member B and the lower supporting member 9. The magnetron part is suitable for a microwave oven. A tungsten wire material having a wire diameter of 0.1 to 1 mm is preferably used for the coil part. The diameter of the coil part is preferably 2 to 6 mm. When the tungsten alloy part of the embodiment is used for the magnetron part, the magnetron part exhibits excellent emission characteristics and excellent high-temperature strength. Therefore, the reliability of the magnetron using the magnetron part can be improved.

Next, a method for producing the tungsten alloy part of the embodiment will be described. As long as the tungsten alloy part of the embodiment has the above constitution, the method for producing the tungsten alloy part is not particularly limited. However, examples of the method for efficiently producing the tungsten alloy part include the following method.

First, tungsten powder used as a raw material is prepared. The average particle diameter of the tungsten powder is preferably 1 to 10 μm. When the average particle diameter is less than 1 μm, the tungsten powder is apt to be aggregated, which makes it difficult to uniformly disperse the ZrC component. When the average particle diameter is more than 10 μm, the average crystal particle diameter as the sintered body may be more than 100 μm. Although the purity of the tungsten powder depends on the application, the tungsten powder preferably has a high purity of 99.0 wt % or more, and more preferably 99.9 wt % or more.

Next, ZrC powder is prepared as the ZrC component. A mixture of Zr powder and carbon powder may be used instead of the ZrC powder. Instead of ZrC powder, a mixture obtained by mixing one or two kinds of selected from the Zr powder and the carbon powder with the ZrC powder may be used. Among these, the ZrC powder is preferably used. Carbon of the ZrC powder is partially decomposed in a sintering process, and reacts with an oxygen impurity in the tungsten powder to be oxidized into carbon dioxide. Carbon dioxide is discharged to the outside of the system. The ZrC powder contributes to the uniformity of the tungsten alloy, which is preferable. When the mixed powder of the Zr powder and carbon powder is used, a load in a production process is increased since both the Zr powder and the carbon powder are uniformly mixed. Since metal Zr is apt to be oxidized, the ZrC powder is preferably used.

The primary particles of the ZrC powder preferably have an average particle diameter of 15 μm or less, and more preferably 0.5 to 5 μm, as described below. When the average particle diameter is less than 0.5 μm, the aggregation of the ZrC powder is large, which makes difficult to uniformly disperse the ZrC powder. When the average particle diameter is more than 15 μm, it is difficult to uniformly disperse the ZrC powder in the grain boundary between the tungsten crystals. From the viewpoint of obtaining a uniform dispersion, the average particle diameter of the ZrC powder is preferably equal to or smaller than the average particle diameter of the tungsten powder.

When the amount of Zr of the ZrC powder and Zr powder is defined as 100 parts by mass, the amount of Hf is preferably 10 parts by mass or less. A Hf component may be contained as impurities in the ZrC powder or the Zr powder. When the amount of Hf is 10 parts by mass or less based on 100 parts by mass of the amount of Zr, degradation of excellent Zr component characteristics can be prevented. Although the amount of Hf is preferably small, highly purified raw material causes a cost increase. Therefore, the amount of Hf is more preferably 0.1 to 3 parts by mass.

At least one dope material selected from the group consisting of K, Si, and Al is added if needed. The addition amount is preferably 0.01 wt % or less.

Next, raw powders are uniformly mixed. A mixing process is preferably performed by using a mixing machine such as a ball mill. The mixing process is preferably performed for 20 hours or more. The raw powders may be mixed with an organic binder or an organic solvent if needed to produce a slurry. A granulation process may be performed if needed.

Next, the raw powders are pressed in a mold to prepare a molded body. The molded body is subjected to a degreasing process if needed. Next, a sintering process is performed. The sintering process is preferably performed under an inert atmosphere such as a nitrogen atmosphere or in a vacuum. Sintering is preferably performed at a temperature of 1400 to 2000° C. for 5 to 20 hours. When the sintering temperature is less than 1400° C. or the sintering time is less than 5 hours, the sintering is insufficient, which decreases the strength of the sintered body. When the sintering temperature is more than 2000° C. or the sintering time is more than 20 hours, the tungsten crystals may overgrow. Carbon in the surface part of the sintered body is likely to be discharged to the outside of the sintered body by sintering under an inert atmosphere or in a vacuum. The sintering can be performed by electric sintering, pressureless sintering, and pressure sintering or the like, and is not particularly limited thereto.

Next, a process of processing the sintered body into a part is performed. Examples of the processing process include a forging process, a rolling process, a wiredrawing process, a cutting process, and a polishing process. Examples of the processing process when the sintered body is processed into a coil part include a coiling process. Examples of the processing process when the mesh grid is prepared as the transmitting tube part include a process of weaving the filament in a mesh form.

Next, the processed part is subjected to a stress relief heat treatment if needed. The stress relief heat treatment is preferably performed at 1300 to 2500° C. under an inert atmosphere or in a vacuum. The stress relief heat treatment is performed, and thereby an internal stress generated in the processing process to the part can be suppressed, which can enhance the strength of the part.

Preferably, the tungsten alloy part of the embodiment contains 0.1 to 5 wt % of Zr in terms of ZrC, and the primary particles of ZrC particles have an average particle diameter of 15 μm or less. The tungsten alloy part preferably contains two kinds (ZrC and Zr). The atomic ratio of C/Zr for ZrC (zirconium carbide) is not limited to 1, and may be 0.6 to 1. Zr is a component functioning as an emitter material in a discharge lamp electrode part. When the content of Zr is less than 0.1 wt % in terms of ZrC, emission characteristics are insufficient. On the other hand, when the content of Zr is more than 5 wt % in terms of ZrC, a strength decrease or the like may be caused. Therefore, the amount of Zr is preferably 0.3 to 3.0 wt % in terms of ZrC, and more preferably 0.5 to 2.5 wt %.

The Zr component exists as ZrC or Zr as described above. Preferably, ZrC exists in a particle form, and the primary particles of ZrC have an average particle diameter of 15 μm or less. The ZrC particles exist in the grain boundary between tungsten crystal particles. Therefore, when the ZrC particles are too large, a clearance between the tungsten crystal particles is enlarged, which causes a density decrease and a strength decrease. When the ZrC particles exist in the grain boundary between the tungsten crystal particles, the ZrC particles function as not only an emission material but also a dispersion reinforcing material. Therefore, the ZrC particles are advantageous in the strength enhancement of an electrode part.

The primary particles of the ZrC particles preferably have an average particle diameter of 5 μm or less and a maximum diameter of 15 μm or less. Further, the primary particles of the ZrC particles preferably have an average particle diameter of 0.1 μm or more and 3 μm or less and a maximum diameter of 1 μm or more and 10 μm or less. The small ZrC particles having an average particle diameter of less than 0.1 μm or a maximum diameter of less than 1 μm may be consumed quickly and disappear due to emission. The ZrC particles preferably have an average particle diameter of 0.1 μm or more or a maximum diameter of 1 μm or more in order to achieve a life improvement of the electrode.

For the dispersion state of the ZrC particles in the tungsten alloy part, 2 to 30 particles preferably exist on an arbitrary straight line having a length of 200 μm. When the number of the ZrC particles is less than 2 (0 to 1 particle) per straight line having a length of 200 μm, the ZrC particles are partially decreased, which increases the variation in emission. On the other hand, when the number of the ZrC particles is more than 30 (31 particles or more) per straight line having a length of 200 μm, a part of the ZrC particles may be excessively increased, to cause an adverse influence such as a strength decrease. The dispersion state of the ZrC particles is investigated by subjecting the arbitrary section of the tungsten alloy to magnification photographing. The magnification ratio of the magnified photograph is set to 1000 times or more. An arbitrary straight line having a length of 200 μm (line thickness: 0.5 mm) is drawn on the magnified photograph, and the number of the ZrC particles existing on the line is counted.

The secondary particles of the ZrC preferably have a maximum diameter of 100 μm or less. The secondary particle of the ZrC is an agglomerate of the primary particles. When the diameter of the secondary particle is more than 100 μm, the strength of the tungsten alloy part is decreased. Therefore, the maximum diameter of the secondary particles of the ZrC particles is preferably 100 μm or less, more preferably 50 μm or less, and still more preferably 20 μm or less.

Zr (metal Zr) has various dispersion states.

In a first dispersion state, metal Zr exists as particles. Metal Zr particles exist in the grain boundary between the tungsten crystal particles as in the ZrC particles. The metal Zr particles exist in the grain boundary between the tungsten crystal particles, and thereby the metal Zr particles also function as the emission material and the dispersion reinforcing material. Therefore, the primary particles of metal Zr preferably have an average particle diameter of 15 μm or less, more preferably 10 μm or less, and still more preferably 0.1 to 3 μm. The primary particles of metal Zr preferably have a maximum diameter of 15 μm or less, and more preferably 10 μm or less. When the tungsten alloy is prepared, the ZrC particles and the metal Zr particles may be previously mixed, or the ZrC particles may be decarbonized in the production process to prepare the metal Zr particles. When a method for decarbonizing the ZrC particles is used, a deoxidation effect for reacting the ZrC particles with oxygen in tungsten and discharging carbon dioxide to the outside of the system is also obtained, which is preferable. An effect for discharging oxygen in tungsten to the outside of the system is obtained, which is preferable. When the deoxidation is possible, the electrical resistance of the tungsten alloy can be decreased, which improves the conductivity of the electrode. A part of the metal Zr particles may be carbonized into the ZrC particles.

In a second dispersion state, metal Zr exists on the surfaces of the ZrC particles. As in the first dispersion state, when the sintered body of the tungsten alloy is prepared, carbon is removed from the surfaces of the ZrC particles, which leads to a state in which a metal Zr film is formed on the surface. Even the ZrC particles with the metal Zr film exhibit excellent emission characteristics. The primary particles of ZrC with the metal Zr film preferably have an average particle diameter of 15 μm or less, more preferably 10 μm or less, and still more preferably 0.1 to 3 μm. The primary particles of ZrC with the metal Zr film preferably have a maximum diameter of 15 μm or less, and more preferably 10 μm or less.

In a third dispersion state, metal Zr is partly or wholly solid-solved in tungsten. Metal Zr forms a solid solution with tungsten. The strength of the tungsten alloy can be enhanced by forming the solid solution. The presence or absence of the solid solution can be determined by XRD analysis. First, the contents of the Zr component and carbon are measured. The contents of Zr and carbon are expressed in $ZrO_x$, to confirm $x<1$. Next, the XRD analysis is performed to confirm that the peak of metal Zr is not detected. Thus, although x of $ZrO_x$ is smaller than 1, and zirconium which is not carbonized into stoichiometric zirconium carbide exists, the peak of metal Zr is not detected. This means that metal Zr is solid-solved in tungsten.

On the other hand, x of $ZrC_x$ is smaller than 1; zirconium which is not carbonized into stoichiometric zirconium carbide exists; and the peak of metal Zr is detected. This case means the first dispersion state where metal Zr is not solid-solved and exists in the grain boundary between the tungsten crystals. The second dispersion state can be analyzed by using EPMA (electron beam microanalyzer) or TEM (transmission electron microscope).

The dispersion state of metal Zr may be any one kind or a combination of two or more kinds of the first dispersion state, the second dispersion state, and the third dispersion state.

When the total content of Zr is defined as 100 parts by mass, the ratio of Zr carbonized into the ZrC particles is preferably 25 to 75 parts by mass. Zr may be wholly carbonized into the ZrC particles. The emission characteristics are obtained by use of the ZrC particles. On the other hand, the conductivity and strength of the tungsten alloy can be enhanced by dispersing metal Zr. However, when Zr is wholly metal Zr, the emission characteristics and the high-temperature strength are decreased. Metal Zr has a melting point of 1850° C.; ZrC has a melting point of 2720° C.; and metal tungsten has a melting point of 3400° C. Since ZrC has a higher melting point than that of metal Zr, the strength at a high-temperature of the tungsten alloy part containing ZrC is enhanced. Since ZrC has a surface current density nearly equal to that of $ThO_2$, electric current equal to that of a thorium dioxide-containing tungsten alloy part can be passed through the tungsten alloy part of the embodiment. Therefore, when the tungsten alloy part of the embodiment is applied to the electrode of the discharge lamp, a current density equal to that of a thorium dioxide-containing tungsten alloy electrode can be set, which eliminates the design change of a control circuit or the like. From these viewpoints, when the total content of the Zr component is defined as 100 parts by mass, the content of Zr contained in ZrC is preferably 25 to 75 parts by mass, and more preferably 35 to 65 parts by mass.

The contents of ZrC and metal Zr in the tungsten alloy can be analyzed as follows. The total amount of Zr in the tungsten alloy is measured according to the ICP analysis method. Next, the total amount of carbon in the tungsten alloy is measured by a combustion-infrared absorption method. When the tungsten alloy is a binary system containing tungsten and Zr, the measured total amount of carbon may be considered to substantially and wholly be contained in ZrC. Therefore, the amount of ZrC can be calculated based on the measured total amount of Zr and total amount of carbon. In the case of using this method, the amount of ZrC is calculated as C/Zr=1.

For the sizes of the ZrC particles, a magnified photograph of an arbitrary section of the tungsten alloy sintered body is taken, and the longest diagonal line of the ZrC particles existing on the section is measured, to define the length of the diagonal line as the particle diameter of the primary particle of ZrC. This measurement is performed for 50 ZrC particles, to define the average value thereof as the average particle diameter of the primary particles of ZrC. The maximum value of the particle diameters (the longest diagonal lines) of the primary particles of ZrC is defined as the maximum diameter of the primary particles of ZrC.

The tungsten alloy part of the embodiment may contain 2 wt % or less of at least one element selected from the group consisting of Ti, V, Nb, Ta, Mo, and rare earth elements. The at least one element selected from the group consisting of Ti, V, Nb, Ta, Mo, and rare earth elements exist in any form of a metal simple substance, oxide, and carbide. The tungsten alloy part may contain two or more kinds of these elements. Even if the tungsten alloy part contains two or more kinds of elements, the total amount thereof is preferably 2 wt % or less. These elements mainly function as the dispersion reinforcing material. Since the ZrC particles function as the emission material, the ZrC particles are consumed when the discharge lamp is used for a long time. On the other hand, since Ti, V, Nb, Ta, Mo, and rare earth elements have weak emission characteristics, these elements are less consumed by emission, and can maintain their function as a dispersion reinforcing material over a long period of time. Although the lower limits of the contents of these elements are not particularly limited, the lower limits are preferably 0.01 wt % or more. Of these elements, the rare earth elements are preferable. Since the rare earth elements have a large atomic radius of 0.16 nm or more, the rare earth elements advantageously increase the surface current density. In other words, a metal simple substance containing an element having an atomic radius of 0.16 nm or more or a compound thereof is preferably used as the dispersion reinforcing material.

Figure 5:
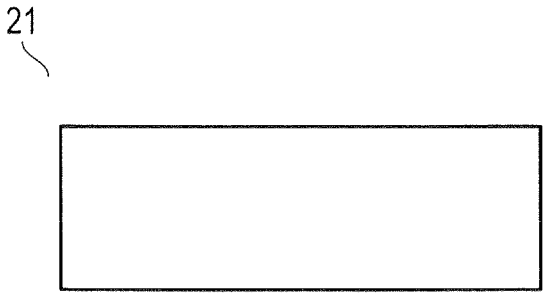
FIG. 5 shows an example of the discharge lamp electrode part of the embodiment.
Figure 6:
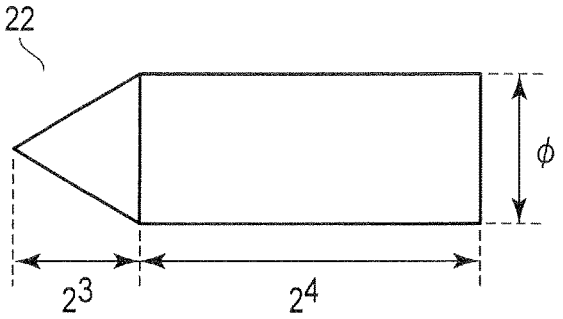
FIG. 6 shows another example of the discharge lamp electrode part of the embodiment.

FIGS. 5 and 6 show an example of a discharge lamp electrode part of an embodiment. In FIGS. 5 and 6, numeral number 21 designates a discharge lamp electrode part; numeral number 22 designates a discharge lamp electrode part having a taper-shaped tip part; numeral number 23 designates a tip part; and numeral number 24 designates a body part. The discharge lamp electrode part 21 has a cylindrical shape. The tip part 23 of the discharge lamp electrode part 21 is tapered to produce the discharge lamp electrode part 22. Although the discharge lamp electrode part 21 before being tapered usually has a cylindrical shape, the discharge lamp electrode part 21 may have a quadrangular prism shape.

The discharge lamp electrode part preferably has a tip part having a tapered tip and a cylindrical body part. The characteristics of the discharge lamp electrode part are improved by tapering, that is, sharpening the tip part. As shown in FIG. 6, the ratio of the length of the tip part 23 to that of the body part 24 is not particularly limited, and is appropriately set in accordance with the application.

The wire diameter $\phi$ of the discharge lamp electrode part is preferably 0.1 to 30 mm. When the wire diameter $\phi$ is less than 0.1 mm, the strength of the electrode part cannot be maintained, which may lead to breakage of the electrode part when the electrode part is incorporated into the discharge lamp or breakage of the electrode part when the tip part is tapered. When the wire diameter $\phi$ is a large value of more than 30 mm, it is difficult to control the uniformity of the tungsten crystal structure, as described below.

Figure 7:
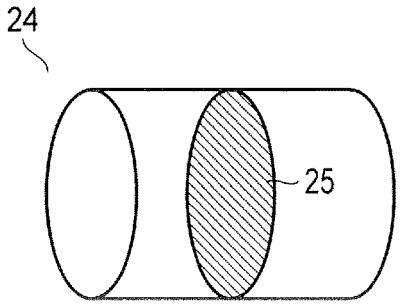
FIG. 7 shows an example of a transverse section of a body part of the discharge lamp electrode part of the embodiment.

When the crystal structure of the transverse section (radial section) of the body part is observed, the area ratio of the tungsten crystals having a crystal particle diameter of 1 to 80 μm per unit area (for example, 300 μm×300 μm) is preferably 90% or more. FIG. 7 shows an example of the transverse section of the body part. In FIG. 7, numeral number 24 designates a body part; and numeral number 25 designates a transverse section. In order to measure the crystal structure of the transverse section, the magnified photograph of the radial section in the center of the length of the body part is taken. When the wire diameter is thin, and unit area of, for example, 300 μm×300 μm cannot be photographed in one viewing field, an arbitrary transverse section is photographed a plurality of times. In the magnified photograph, the longest diagonal line of the tungsten crystal particles existing in the section of the magnified photograph is defined as the maximum diameter. In the section, the area ratio of the tungsten crystal particles having a maximum diameter falling within a range of 1 to 80 μm is calculated.

The area ratio of the tungsten crystals having a crystal particle diameter of 1 to 80 μm per unit area of the transverse section of the body part is 90% or more. This shows that the small tungsten crystals having a crystal particle diameter of less than 1 μm and the large tungsten crystals having a crystal particle diameter of more than 80 μm are few. When the tungsten crystals of less than 1 μm are too many, the grain boundary between the tungsten crystal particles is too small. When the ratio of the ZrC particles is increased in the grain boundary between the tungsten crystal particles, and the ZrC particles are consumed by emission, large defects are formed, which decreases the strength of the tungsten alloy. On the other hand, when the number of large tungsten crystal particles of more than 80 μm is increased, the grain boundary is too large, which decreases the strength of the tungsten alloy. The area ratio of the tungsten crystals having a crystal particle diameter of 1 to 80 μm per unit area of the transverse section of the body part is preferably 96% or more, and more preferably 100%.

The average particle diameter of the tungsten crystal particles in the transverse section is preferably 50 μm or less, and more preferably 20 μm or less. The average aspect ratio of the tungsten crystal particles in the transverse section is preferably less than 3. The aspect ratio is calculated as follows. A magnified photograph of unit area (for example, 300 μm×300 μm) is taken; the maximum diameter (Feret diameter) of the tungsten crystal particles existing in the section is defined as a major axis L; the particle diameter vertically extending from the center of the major axis L is defined as a minor axis S; and major axis L/minor axis S (the major axis L is divided by the minor axis S)=aspect ratio is set. This measurement is performed for 50 tungsten crystal particles, and the average value thereof is defined as the average aspect ratio. (Major axis L+minor axis S)/2 (total of the major axis L and minor axis S is divided by 2)=particle diameter is set, and the average value of the 50 tungsten crystal particles is defined as the average particle diameter.

Figure 8:
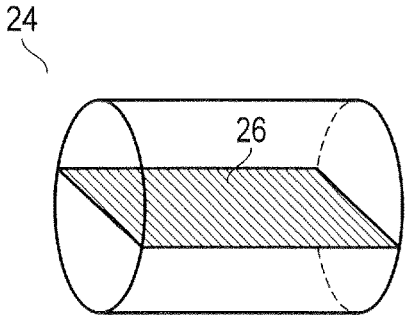
FIG. 8 shows an example of a vertical section of the body part of the discharge lamp electrode part of the embodiment.

When the crystal structure of the vertical section of the body part is observed, the area ratio of the tungsten crystals having a crystal particle diameter of 2 to 120 μm per unit area (for example, 300 μm×300 μm) is preferably 90% or more. FIG. 8 shows an example of the vertical section. In FIG. 8, numeral number 24 designates a body part; and numeral number 26 designates a vertical section. In order to measure the crystal structure of the vertical section, the magnified photograph of the vertical section passing through the center of the diameter of the body part is taken. When a unit area of, for example, 300 μm×300 μm cannot be photographed in one viewing field, an arbitrary transverse section is photographed a plurality of times. In the magnified photograph, the longest diagonal line of the tungsten crystal particles existing in the section of the magnified photograph is defined as the maximum diameter. In the section, the area ratio of the tungsten crystal particles having a maximum diameter falling within a range of 2 to 120 μm is calculated.

The area ratio of the tungsten crystals having a crystal particle diameter of 2 to 120 μm per unit area of the vertical section of the body part is 90% or more. This shows that the small tungsten crystals having a crystal particle diameter of less than 2 μm and the large tungsten crystals having a crystal particle diameter of more than 120 μm are few. When the tungsten crystals of less than 2 μm are too many, the grain boundary between the tungsten crystal particles is too small. When the ratio of the ZrC particles is increased in the grain boundary between the tungsten crystal particles, and the ZrC particles are consumed by emission, large defects are formed, which decreases the strength of the tungsten alloy. On the other hand, when the number of large tungsten crystal particles of more than 120 μm is increased, the grain boundary is too large, which decreases the strength of the tungsten alloy. The area ratio of the tungsten crystals having a crystal particle diameter of 2 to 120 μm per unit area of the vertical section of the body part is preferably 96% or more, and more preferably 100%.

The average particle diameter of the tungsten crystal particles in the vertical section is preferably 70 μm or less, and more preferably 40 μm or less. The average aspect ratio of the tungsten crystal particles in the vertical section is preferably 3 or more. A method for measuring the average particle diameter and the average aspect ratio is the same as that used for the transverse section.

As described above, a tungsten alloy having excellent discharge characteristics and strength, particularly an excellent strength at a high-temperature can be provided by controlling the sizes of the tungsten crystal particles, and the sizes and ratio of the ZrC particles. Therefore, the characteristics of the discharge lamp electrode part are also improved.

The tungsten alloy part preferably has a relative density of 95.0% or more, and more preferably 98.0% or more. When the relative density is less than 95.0%, air bubbles are increased, which may cause adverse influences such as a strength decrease and partial discharge. The relative density is obtained by the calculation of (measured density/theoretical density)×100(%)=relative density and by using a measured density according to an Archimedes method and a theoretical density. The theoretical density is obtained by calculation from the density and mass ratio of a known component. Herein, the density of tungsten is 19.3 g/cm$^3$; the density of zirconium is 6.51 g/cm$^3$; and the theoretical density of zirconium carbide is 6.73 g/cm$^3$. For example, in the case of a tungsten alloy containing 1 wt % of ZrC, 0.2 wt % of Zr, and the remainder being tungsten, the theoretical density is $6.51\times0.01+6.73\times0.002+19.3\times0.988=19.14696$ g/cm$^3$. When the theoretical density is calculated, the existence of impurities may not be considered.

The tungsten alloy part of the embodiment preferably has a Vickers hardness of Hv 330 or more, and more preferably Hv 330 to 700. When the Vickers hardness is less than Hv 330, the tungsten alloy is too soft, which decreases the strength. On the other hand, when the Vickers hardness is more than Hv 700, the tungsten alloy is too hard, which makes it difficult to process the tip part into a taper shape. When the tungsten alloy is too hard, an electrode part having a long body part has no flexibility, and may be apt to be broken. When the Vickers hardness Hv is 330 or more, the three point bending strength of the tungsten alloy can be increased to 400 MPa or more.

When the tungsten alloy part of the embodiment is applied to the discharge lamp electrode, a surface roughness Ha is preferably 5 μm or less. Particularly, the tip part preferably has a surface roughness Ra of 5 μm or less, and more preferably 3 μm or less. When surface unevenness is large, emission characteristics are deteriorated.

The above tungsten alloy part can be applied to various discharge lamps. The discharge lamps are not particularly limited to the low-pressure discharge lamp and the high-pressure discharge lamp or the like. Therefore, even if a large voltage of 100 V or more is applied, a long life can be achieved. The wire diameter of the body part is within a range of 0.1 to 30 mm. The wire diameter capable of being applied is a thin size of 0.1 mm or more and 3 mm or less, a medium size of more than 3 mm and 10 mm or less, and a thick size of more than 10 mm and 30 mm or less. The length of the electrode body part is preferably 10 to 600 mm.

Figure 9:
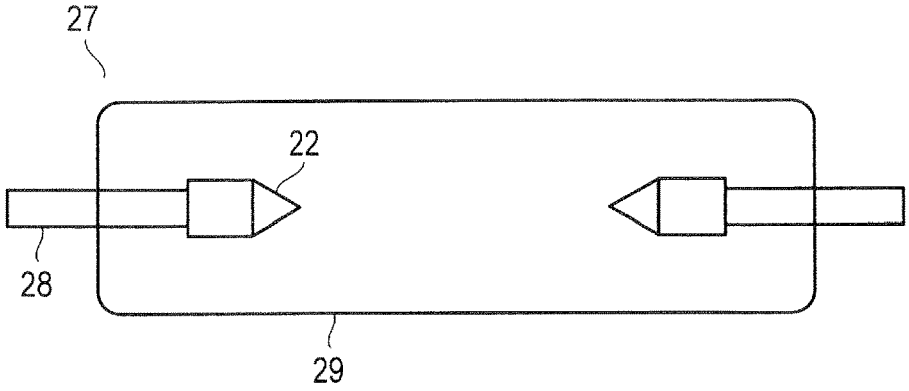
FIG. 9 shows an example of a discharge lamp of an embodiment.

FIG. 9 shows an example of the discharge lamp. In FIG. 9, numeral number 22 designates an electrode part (having a tapered tip part); numeral number 27 designates a discharge lamp; numeral number 28 designates an electrode supporting rod; and numeral number 29 designates a glass tube. In the discharge lamp 27, the pair of electrode parts 22 are disposed in a state where electrode tip parts face each other. The electrode parts 22 are joined to the electrode supporting rod 28. A phosphor layer which is not shown is provided on the inner surface of the glass tube 29. A mercury, halogen, or argon gas (or neon gas) or the like is enclosed in the glass tube 29 if needed.

The tungsten alloy part of the embodiment is used for the discharge lamp of the embodiment. The kind of the discharge lamp is not particularly limited. The discharge lamp can be applied to both a low-pressure discharge lamp and a high-pressure discharge lamp. Examples of the low-pressure discharge lamp include various arc-discharge type discharge lamps such as for general lighting, special lighting used for a road and a tunnel or the like, a curing apparatus for a coating material, a UV curing apparatus, a sterilizer, and a light cleaning apparatus for a semiconductor or the like. Examples of the high-pressure discharge lamp include a processing apparatus for water supply and sewerage, general lighting, outdoor lighting for a stadium or the like, a UV curing apparatus, an exposure device for a semiconductor and a printed circuit board or the like, a wafer inspection apparatus, a high-pressure mercury lamp such as a projector, a metal halide lamp, an extra high pressure mercury lamp, a xenon lamp, and a sodium lamp. Since the strength of the tungsten alloy is improved, the discharge lamp can also be applied to a field involving movement (vibration) such as an automotive discharge lamp.

Next, a production method will be described. As long as the tungsten alloy part of the embodiment has the above constitution, the production method is not particularly limited. However, examples of the production method for efficiently obtaining the tungsten alloy part include the following method.

First, tungsten alloy powder containing a Zr component is prepared. ZrC powder is prepared as the Zr component. The primary particles of the ZrC powder preferably have an average particle diameter of 15 μm or less, and more preferably an average particle diameter of 5 μm or less. Preferably, ZrC powder having a maximum diameter of more than 15 μm is previously removed by using a sieve. When a maximum diameter is desired to be set to 10 μm or less, large ZrC particles are removed by using a sieve having a predetermined mesh diameter. When the ZrC particles having a small particle diameter are desired to be removed, the ZrC particles are removed by using a sieve having a predetermined mesh diameter. Before sieving, the ZrC particles are preferably subjected to a pulverizing process in a ball mill or the like. Since the aggregate can be broken by performing the pulverizing process, particle diameter control according to sieving is likely to be performed.

Next, metal tungsten powder is mixed. The metal tungsten powder preferably has an average particle diameter of 0.5 to 10 μm. The metal tungsten powder preferably has purity of 98.0 wt % or more, a carbon content of 1 wt % or less, and an impurity metal component of 1 wt % or less. It is preferable that the metal tungsten powder is previously pulverized in a ball mill or the like as in the ZrC particles, and small particles and large particles are removed in a sieving process.

The metal tungsten powder is added so that a Zr content is set to 0.1 to 5 wt % in terms of ZrC. A mixed powder of ZrC particles and metal tungsten powder is put into a mixing vessel, and the mixing vessel is rotated, to uniformly mix the mixed powder. At this time, the mixed powder can be smoothly mixed by using a cylindrical mixing vessel as the mixing vessel, and rotating the cylindrical mixing vessel in a circumferential direction. The tungsten powder containing the ZrC particles can be prepared by this process. In consideration of decarburization during a sintering process to be described below, a small amount of carbon powder may be added. At this time, the amount of the carbon powder to be added is set to be equal to or less than the same amount as the amount of carbon to be decarbonized.

Next, a molded body is produced by using the obtained tungsten powder containing the ZrC particles. When the molded body is formed, a binder is used if needed. When a cylindrical molded body is formed, the diameter of the molded body is preferably set to 0.1 to 40 mm. When a molded body is cut out from a plate-like sintered body as described below, the size of the molded body is arbitrary. The length (thickness) of the molded body is arbitrary.

Next, the molded body is presintered. The presintering is preferably performed at 1250 to 1500° C. A presintered body can be obtained by this process. Next, the presintered body is subjected to electric sintering. The electric sintering is preferably performed under a condition where the temperature of the sintered body is set to 2100 to 2500° C. When the temperature is less than 2100° C., the sintered body cannot be sufficiently densified, which decreases the strength. When the temperature is more than 2500° C., the ZrC particles and the tungsten particles overgrow, and the intended crystal structure is not obtained.

In another method, the molded body may be sintered at a temperature of 1400 to 3000° C. for 1 to 20 hours. When the sintering temperature is less than 1400° C. or the sintering time is less than 1 hour, the sintering is insufficient, which decreases the strength of the sintered body. When the sintering temperature is more than 3000° C. or the sintering time is more than 20 hours, the tungsten crystals may overgrow.

Examples of the sintering atmosphere include an inert atmosphere such as a nitrogen or argon atmosphere, a reducing atmosphere such as a hydrogen atmosphere, and a vacuum. Under any of these atmospheres, carbon in the ZrC particles is removed during the sintering process. Since a carbon impurity in the tungsten powder is also removed during decarbonization, the carbon content in the tungsten alloy can be decreased to 1 wt % or less, and further to 0.5 wt % or less. When the carbon content in the tungsten alloy is decreased, the conductivity is improved.

A Zr-containing tungsten sintered body can be obtained by the sintering process. When the presintered body has a cylindrical shape, the sintered body is also a cylindrical sintered body (ingot). In the case of the plate-like sintered body, the cylindrical sintered body (ingot) can be obtained by a process of cutting out the plate-like sintered body into a predetermined size.

Next, the cylindrical sintered body (ingot) is subjected to forging processing, rolling processing, and wiredrawing processing or the like, to adjust the wire diameter. A processing ratio in that case is preferably within a range of 30 to 90%. When the sectional area of the cylindrical sintered body before processing is defined as A and the sectional area of the cylindrical sintered body after processing is defined as B, the processing ratio is obtained by the processing ratio of $[(A-B)/A]\times100\%$. The wire diameter is preferably adjusted by a plurality of such processes. The pores of the cylindrical sintered body before processing can be crushed by performing the plurality of such processes, to obtain a high-density electrode part.

Next will be described a case where a cylindrical sintered body having a diameter of 25 mm is processed into a cylindrical sintered body having a diameter of 20 mm, for example. Since the sectional area A of a circle having a diameter of 25 mm is 460.6 $mm^2$ and the sectional area B of a circle having a diameter of 20 mm is 314 $mm^2$, the processing ratio is $[(460.6-314)/460.6]\times100=32\%$. At this time, the diameter of the cylindrical sintered body to be processed is preferably set to 20 mm from 25 mm by a plurality of wiredrawing processings or the like.

When the processing ratio is a low value of less than 30%, the crystal structure is not sufficiently stretched in the processing direction, which makes it difficult to set the tungsten crystals and the ZrC particles at the intended size. When the processing ratio is a small value of less than 30%, the pores in the cylindrical sintered body before processing are not sufficiently crushed, and may remain as is. The remaining internal pores cause a decrease in the durability or the like of a cathode part. On the other hand, when the processing ratio is a large value of more than 90%, the sintered body is excessively processed, which may cause disconnections and decrease the yield. For this reason, the processing ratio is preferably 30 to 90%, and more preferably 35 to 70%. When the relative density of the sintered tungsten alloy is 95% or more, the sintered tungsten alloy may not be necessarily processed at the above processing ratio.

After the wire diameter of the sintered body is processed to 0.1 to 30 mm, the electrode part can be prepared by cutting the sintered body to a required length. The tip part is processed into a taper shape if needed. Polishing processing, a heat treatment (recrystallization heat treatment or the like), and shape processing are performed if needed.

The recrystallization heat treatment is preferably performed at 1300 to 2500° C. under a reducing atmosphere, under an inert atmosphere, or in a vacuum. The effect of the stress relief heat treatment suppressing the internal stress generated in the processing process to the electrode part is obtained by performing the recrystallization heat treatment, and the strength of the part can be enhanced.

The above production method can efficiently produce the discharge lamp electrode part of the embodiment.

EXAMPLES

Example 1

As raw powders, 2 wt % of ZrC powder (purity: 99.0%) having an average particle diameter of 2 μm was added to tungsten powder (purity: 99.99 wt %) having an average particle diameter of 4 μm. When the amount of Zr for the ZrC powder was defined as 100 parts by mass, the amount of impurity Hf was 0.8 parts by mass.

The raw powders were mixed in a ball mill for 30 hours, to prepare a mixed raw powder. Next, the mixed raw powder was put into a mold, to produce a molded body. The obtained molded body was subjected to electric sintering in a vacuum ($10^{-3}$ Pa) at 1800° C. for 10 hours. A sintered body having a height of 16 mm, a width of 16 mm, and a length of 420 mm was obtained by the process.

Next, a cylindrical sample having a diameter of 2.4 mm and a length of 150 mm was cut out. The sample was subjected to centerless polishing processing, to set a surface roughness Ra to 5 μm or less. Next, a tip part was processed into a conic shape having an inclination angle of 45 degrees. Next, a stress relief heat treatment was performed in a vacuum ($10^{-3}$ Pa) at 1600° C.

Thereby, a discharge lamp cathode part was prepared as a tungsten alloy part according to Example 1.

Comparative Example 1

A discharge lamp cathode part was prepared, which was made of a tungsten alloy containing 2 wt % of $ThO_2$ and had the same size as that of the discharge lamp cathode part of Example 1.

The content of a ZrC component, the amounts of carbon in a surface part and a central part, and the average particle diameter of tungsten crystals were investigated for the tungsten alloy part of Example 1. The content of the ZrC component was calculated by converting the amount of Zr and amount of carbon obtained by ICP analysis into $ZrC_x$. The amounts of carbon in the surface part and the central part were analyzed as follows. Measurement samples were cut out from a range between a surface and a position distant by 10 μm from the surface and a cylindrical section, and the amounts of carbon in the measurement samples were measured. The average value of the crystal particle diameters of 100 tungsten crystals measured in an arbitrary section was defined as the average crystal particle diameter of tungsten. The results are shown in Table 1.

TABLE 1

| | In terms of ZrC (wt %) | x value when converted into $ZrC_x$ | Amount of carbon in surface part (wt %) | Amount of carbon in central part (wt %) | Average crystal particle diameter of tungsten (μm) |
|---|---|---|---|---|---|
| Example 1 | 2 | 0.5 | 0.45 | 0.56 | 34 |

Next, there were investigated the emission characteristics of the discharge lamp cathode parts of Example 1 and Comparative Example 1. For the measurement of the emission characteristics, emission current densities ($mA/mm^2$) were measured by changing an applied voltage (V) to 100 V, 200 V, 300 V, and 400 V. The emission current densities were measured under conditions of an electric current load of 18 (±0.5) A/W applied to the cathode part and an applied time of 20 ms. The results are shown in FIG. 10.

Figure 10:
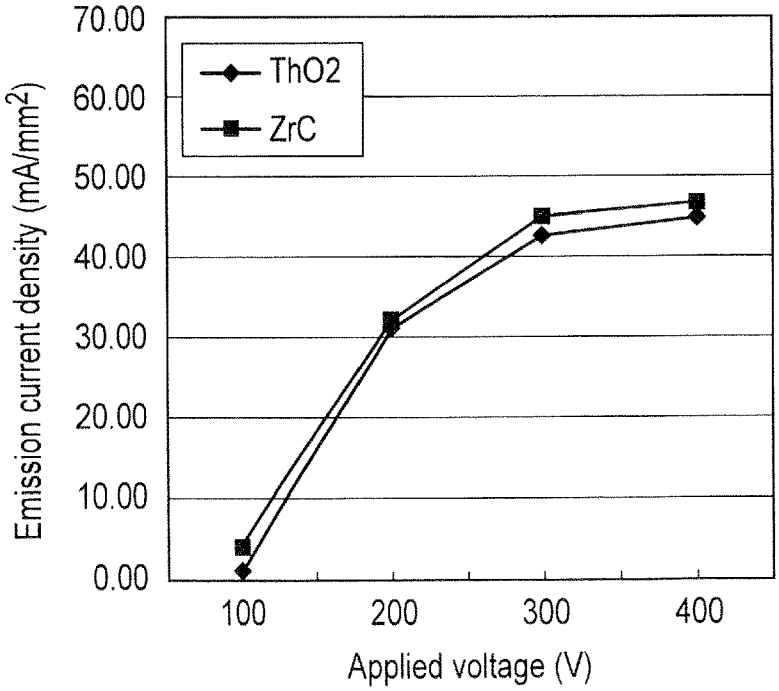
FIG. 10 shows the relationship between an emission current density and an applied voltage of Example 1 and Comparative Example 1.

As can be seen from FIG. 10, it was found that Example 1 has more excellent emission characteristics than those of Comparative Example 1. As a result, it is found that the discharge lamp cathode part of Example 1 exhibits excellent emission characteristics without using thorium oxide which is a radioactive material. The temperature of the cathode part was 2100 to 2200° C. during measurement. For this reason, it is found that the cathode part according to Example 1 has excellent high-temperature strength.

Examples 2 to 5

Next, there were prepared raw mixed powders in which the addition amount of ZrC and the addition amount of K as a dope material were changed as shown in Table 2. The raw mixed powders were subjected to metal molding, and sintered in a vacuum ($10^{-3}$ Pa or less) at 1500 to 1900° C. for 7 to 16 hours, to obtain sintered bodies. In Examples 2 and 3, a cutting-out process was performed under a condition where the size of the sintered body was the same as that of Example 1. In Examples 4 and 5, the sizes of the molded bodies were adjusted, to directly obtain sintered bodies having a diameter of 2.4 mm and a length of 150 mm.

Each of the samples was subjected to centerless polishing processing to set a surface roughness Ra to 5 μm or less. Next, a tip part was processed into a conic shape having an inclination angle of 45 degrees. Next, a stress relief heat treatment was performed in a vacuum ($10^{-3}$ Pa or less) at 1400 to 1700° C. Thereby, discharge lamp cathode parts according to Examples 2 to 5 were prepared, and measured in the same manner as in Example 1. The results are shown in Table 3.

TABLE 2

| | Addition amount of ZrC | Addition amount of K |
|---|---|---|
| Example 2 | 0.6 | None |
| Example 3 | 1.0 | None |
| Example 4 | 2.5 | 0.005 |
| Example 5 | 1.3 | None |

TABLE 3

| | In terms of ZrC (wt %) | x value when converted into $ZrC_x$ | Amount of carbon in surface part (wt %) | Amount of carbon in central part (wt %) | Average crystal particle diameter of tungsten (μm) |
|---|---|---|---|---|---|
| Example 2 | 0.6 | 0.61 | 0.57 | 0.65 | 28 |
| Example 3 | 1.0 | 0.46 | 0.40 | 0.51 | 65 |
| Example 4 | 2.5 | 0.44 | 0.39 | 0.48 | 52 |
| Example 5 | 1.3 | 0.51 | 0.40 | 0.55 | 42 |

Next, emission characteristics were estimated under the same condition as that of Example 1. The results are shown in Table 4.

TABLE 4

| | Emission current density ($mA/mm^2$) | | | |
|---|---|---|---|---|
| | Applied voltage 100 V | Applied voltage 200 V | Applied voltage 300 V | Applied voltage 400 V |
| Example 2 | 1.76 | 32.1 | 43.1 | 45.1 |
| Example 3 | 1.98 | 32.5 | 44.6 | 47.5 |
| Example 4 | 2.24 | 36.6 | 48.5 | 50.2 |
| Example 5 | 2.12 | 34.6 | 44.8 | 48.8 |

As can be seen from Table 4, the discharge lamp cathode parts according to the Examples exhibited excellent characteristics. The temperatures of the cathode parts were 2100 to 2200° C. during measurement. For this reason, it is found that the cathode parts according to Examples 2 to 5 have excellent strength at a high-temperature. Examples 1 to 5 contained two kinds (Zr and ZrC).

Examples 11 to 20 and Comparative Example 11

Tungsten powder (purity: 99.0 wt % or more) and ZrC powder shown in Table 5 were prepared as raw powders. The powders were sufficiently loosened in a ball mill, and subjected to a sieving process so that the maximum diameters thereof were set to values shown in Table 5 if needed.

TABLE 5

| | Tungsten powder | | | | ZrC powder | |
|---|---|---|---|---|---|---|
| | Average particle diameter (μm) | Maximum diameter (μm) | Oxygen content (wt %) | Carbon content (wt %) | Average particle diameter of primary particles (μm) | Maximum diameter of secondary particles (μm) |
| Example 11 | 1 | 6 | 0.2 | <0.01 | 1.2 | 7.0 |
| Example 12 | 2 | 9 | 0.2 | <0.01 | 2.5 | 8.0 |
| Example 13 | 3 | 12 | 0.2 | <0.01 | 4.5 | 10.0 |
| Example 14 | 5 | 16 | 0.8 | <0.01 | 4.7 | 10.0 |
| Example 15 | 8 | 28 | 0.8 | <0.01 | 8.3 | 13.0 |
| Example 16 | 2 | 7 | 0.5 | <0.01 | 2.6 | 9.5 |
| Example 17 | 3 | 15 | 0.5 | <0.01 | 3.1 | 11.5 |
| Example 18 | 2 | 6 | 0.1 | <0.01 | 0.7 | 3.2 |
| Example 19 | 2 | 6 | 0.1 | <0.01 | 0.7 | 3.2 |
| Example 20 | 2 | 6 | 0.1 | <0.01 | 0.7 | 3.2 |
| Comparative Example 11 | 5 | 40 | 0.8 | <0.01 | 20 | 50 |

Next, the tungsten powder and the ZrC powder were mixed at ratios shown in Table 6, and mixed in the ball mill again. Next, the mixtures were molded to prepare molded bodies. Next, a sintering process was performed under conditions shown in Table 6. Sintered bodies having a height of 16 mm, a width of 16 mm, and a length of 420 mm were obtained.

TABLE 6

| | Amount of Zr component (in terms of ZrC, wt %) | Sintering process |
|---|---|---|
| Example 11 | 0.5 | Under nitrogen atmosphere, presintering, 1400° C. → Electric sintering, 2300° C. |
| Example 12 | 1.0 | Under hydrogen atmosphere, presintering, 1350° C. → Electric sintering, 2200° C. |
| Example 13 | 1.5 | Under hydrogen atmosphere, furnace sintering, 1900° C. |
| Example 14 | 2.0 | Under nitrogen atmosphere, presintering, 1450° C. → Electric sintering, 2200° C. |
| Example 15 | 2.5 | Under hydrogen atmosphere, furnace sintering, 1800° C. |
| Example 16 | 1.5 | Under hydrogen atmosphere, presintering, 1400° C. → Electric sintering, 2250° C. |
| Example 17 | 1.0 | Under hydrogen atmosphere, furnace sintering, 1950° C. |
| Example 18 | 0.8 | Under nitrogen atmosphere, presintering, 1380° C. → Electric sintering, 2300° C. |
| Example 19 | 0.2 | Under hydrogen atmosphere, presintering, 1390° C. → Electric sintering, 2270° C. |
| Example 20 | 4.2 | Under hydrogen atmosphere, furnace sintering, 1950° C. |
| Comparative Example 11 | 2.5 | Under hydrogen atmosphere, furnace sintering, 1800° C. |

Next, cylindrical sintered bodies (ingots) were cut out from the obtained tungsten alloy sintered bodies, and the wire diameters were adjusted by appropriately combining forging processing, rolling processing, and wiredrawing processing. Processing ratios were as shown in Table 7. The wire diameters were adjusted. Then, the sintered bodies were cut to a predetermined length, and the tip parts were processed into a taper shape. Then, the sintered bodies were subjected to surface polishing, to set surface roughnesses Ra to 5 μm or less. Next, the sintered bodies were subjected to a recrystallization heat treatment at 1600° C. under a hydrogen atmosphere. Thereby, discharge lamp electrode parts were completed.

TABLE 7

| | Cylindrical sintered body (ingot) | | Wire | |
|---|---|---|---|---|
| | Kind of cylindrical sintered body | Diameter mm × Length mm | diameter of electrode part (mm) | Processing ratio (%) |
| Example 11 | Example 11 | 5 mm × 50 mm | 3 mm | 64 |
| Example 12 | Example 12 | 10 mm × 100 mm | 8 mm | 36 |

TABLE 7-continued

| | Cylindrical sintered body (ingot) | | Wire | |
|---|---|---|---|---|
| | Kind of cylindrical sintered body | Diameter mm × Length mm | diameter of electrode part (mm) | Processing ratio (%) |
| Example 13 | Example 13 | 20 mm × 100 mm | 16 mm | 36 |
| Example 14 | Example 14 | 26 mm × 100 mm | 20 mm | 41 |
| Example 15 | Example 15 | 35 mm × 100 mm | 25 mm | 49 |
| Example 16 | Example 16 | 22.4 mm × 100 mm | 10 mm | 80 |
| Example 17 | Example 17 | 1.2 mm × 50 mm | 1 mm | 70 |
| Example 18 | Example 18 | 5 mm × 50 mm | 3 mm | 64 |
| Example 19 | Example 19 | 10 mm × 100 mm | 8 mm | 36 |
| Example 20 | Example 20 | 35 mm × 100 mm | 25 mm | 49 |
| Comparative Example 11-1 | Comparative Example 11 | 10 mm × 50 mm | 3 mm | 91 |
| Comparative Example 11-2 | Comparative Example 11 | 9 mm × 100 mm | 8 mm | 21 |

TABLE 8

| | Tungsten crystal particle diameter | | | | | | ZrC particles | | |
|---|---|---|---|---|---|---|---|---|---|
| | Transverse section | | | Vertical section | | | | | |
| | Ratio of 1 to 80 μm(%) | Average particle diameter (μm) | Average aspect ratio | Ratio of 2 to 120 μm(%) | Average particle diameter (μm) | Average aspect ratio | Average particle diameter of primary particles (μm) | Maximum diameter of primary particles (μm) | Maximum diameter of secondary particles (μm) |
| Example 11 | 100 | 12.2 | 2.7 | 100 | 16.9 | 4.3 | 1.2 | 2.6 | 7.0 |
| Example 12 | 100 | 24.8 | 2.2 | 100 | 33.9 | 3.4 | 2.5 | 4.4 | 8.0 |
| Example 13 | 98 | 33.2 | 2.4 | 97 | 44.5 | 3.6 | 4.5 | 7.0 | 10.0 |
| Example 14 | 94 | 47.4 | 2.6 | 93 | 74.0 | 3.7 | 4.7 | 6.8 | 10.0 |
| Example 15 | 90 | 56.5 | 2.8 | 92 | 79.8 | 3.8 | 8.3 | 11.2 | 13.0 |
| Example 16 | 100 | 23.9 | 3.0 | 100 | 36.9 | 3.9 | 2.6 | 4.8 | 9.5 |
| Example 17 | 100 | 35.7 | 2.9 | 100 | 55.2 | 4.0 | 3.1 | 5.0 | 11.5 |
| Example 18 | 100 | 23.8 | 2.4 | 100 | 30.2 | 4.0 | 0.7 | 1.7 | 3.2 |
| Example 19 | 100 | 26.6 | 2.3 | 100 | 35.2 | 3.6 | 0.7 | 1.7 | 3.2 |
| Example 20 | 100 | 29.3 | 2.5 | 100 | 37.5 | 3.7 | 0.7 | 1.7 | 3.2 |
| Comparative Example 11-1 | 73 | 53.5 | 3.8 | 68 | 111.2 | 5.3 | 20 | 30.1 | 50 |
| Comparative Example 11-2 | 90 | 58.9 | 1.8 | 93 | 58.5 | 2.0 | 20 | 30.1 | 50 |

Next, the ratio of ZrC was measured for each of the discharge lamp electrode parts. An oxygen content, a relative density (%), a Vickers hardness (H v), and a three point bending strength were obtained.

The ratio of ZrC was obtained by measuring the amount of Zr in the tungsten alloy according to an ICP analysis method and the amount of carbon in the tungsten alloy according to a combustion-infrared absorption method. Carbon in the tungsten alloy may be considered to be contained in ZrC. Therefore, the detected total amount of Zr was defined as 100 parts by weight, and the amount of Zr contained in ZrC was calculated. The mass ratio thereof was obtained. The oxygen content in the tungsten alloy was analyzed by an inert gas combustion-infrared absorption method. The relative density was obtained by dividing a measured density analyzed by an Archimedes method by a theoretical density. The theoretical density was obtained by the above calculation. The Vickers hardness (Hv) was obtained according to JIS-Z-2244. The three point bending strength was obtained according to JIS-R-1601. The results are shown in Table 9.

TABLE 9

| | x value when expressed in $ZrC_x$ | Parts by mass of Zr contained in ZrC when the total amount of Zr is defined as 100 parts by mass | Oxygen content in tungsten alloy (wt %) | Relative density (%) | Vickers hardness (Hv) | Three point bending strength (MPa) |
|---|---|---|---|---|---|---|
| Example 11 | 0.70 | 70 | 0.1 | 99.0 | 485 | 500 |
| Example 12 | 0.50 | 50 | <0.01 | 96.0 | 422 | 432 |
| Example 13 | 0.40 | 40 | <0.01 | 96.2 | 425 | 455 |
| Example 14 | 0.75 | 75 | 0.4 | 98.1 | 486 | 479 |
| Example 15 | 0.35 | 35 | <0.01 | 98.9 | 490 | 488 |
| Example 16 | 0.60 | 60 | <0.01 | 99.5 | 500 | 513 |
| Example 17 | 0.55 | 55 | <0.01 | 99.2 | 491 | 505 |
| Example 18 | 0.65 | 65 | <0.01 | 99.3 | 495 | 503 |
| Example 19 | 0.48 | 48 | <0.01 | 97.4 | 430 | 434 |
| Example 20 | 0.33 | 33 | <0.01 | 99.2 | 479 | 476 |
| Comparative Example 11-1 | 0.48 | 48 | 0.2 | 99.1 | 810 | 380 |
| Comparative Example 11-2 | 0.48 | 48 | 0.2 | 91.7 | 277 | 318 |

The discharge lamp electrode parts according to the Examples had high density, an excellent Vickers hardness (Hv), and an excellent three point bending strength. This was because a part of ZrC was decarbonized. The Zr component which was not carbonized into ZrC was in any state of a state of metal Zr particles, a state where a part of surfaces of ZrC particles were metal Zr, and a state of a solid solution of tungsten and zirconium. Since Comparative Example 11-1 had large ZrC particles, the ZrC particles became destructive starting points, which decreased the strength.

Examples 21 to 25

Next, the same tungsten powder and ZrC powder as those in Example 12 were used, and a second component changed to a composition shown in Table 10 was prepared. These were subjected to furnace sintering at 2000° C. under a sintering condition of a hydrogen atmosphere, to obtain ingots. The ingots were processed at a processing ratio of 50%, to obtain electrode parts having a wire diameter of 10 mm. The electrode parts were subjected to a recrystallization heat treatment at 1600° C. in a hydrogen atmosphere. The same measurement was performed for each of Examples. The results were as shown in Tables 10 to 12.

TABLE 10

| | Amount of Zr component (in terms of ZrC, wt %) | Addition component (material/wt %) |
|---|---|---|
| Example 21 | 1.0 | K/0.005 |
| Example 22 | 1.0 | Hf/0.01 |
| Example 23 | 1.0 | Hf/0.5 |
| Example 24 | 1.0 | HfC/0.1 |
| Example 25 | 1.0 | Ta/0.2 |

TABLE 11

| | Tungsten crystal particle diameter | | | | | | ZrC particles | | |
|---|---|---|---|---|---|---|---|---|---|
| | Transverse section | | | Vertical section | | | Average | | |
| | Ratio of 1 to 80 μm(%) | Average particle diameter (μm) | Average aspect ratio | Ratio of 2 to 120 μm(%) | Average particle diameter (μm) | Average aspect ratio | particle diameter of primary particles (μm) | Maximum diameter of primary particles (μm) | Maximum diameter of secondary particles (μm) |
| Example 21 | 100 | 28.8 | 2.3 | 100 | 37.9 | 3.7 | 2.5 | 4.2 | 8.0 |
| Example 22 | 100 | 26.0 | 2.3 | 100 | 34.7 | 3.2 | 2.5 | 4.2 | 8.0 |
| Example 23 | 100 | 26.5 | 2.4 | 100 | 36.7 | 3.8 | 2.5 | 4.2 | 8.0 |
| Example 24 | 100 | 28.2 | 2.4 | 100 | 37.1 | 3.5 | 2.5 | 4.2 | 8.0 |
| Example 25 | 100 | 27.5 | 2.3 | 100 | 38.0 | 3.4 | 2.5 | 4.2 | 8.0 |

TABLE 12

| | x value when expressed in $ZrC_x$ | Parts by mass of Zr contained in ZrC when the total amount of Zr is defined as 100 parts by mass | Oxygen content in tungsten alloy (wt %) | Relative density (%) | Vickers hardness (Hv) | Three point bending strength (MPa) |
|---|---|---|---|---|---|---|
| Example 21 | 0.55 | 55 | <0.01 | 98.1 | 435 | 450 |
| Example 22 | 0.53 | 53 | <0.01 | 98.4 | 430 | 440 |
| Example 23 | 0.48 | 48 | <0.01 | 98.3 | 434 | 441 |
| Example 24 | 0.48 | 48 | <0.01 | 98.9 | 440 | 446 |
| Example 25 | 0.46 | 46 | <0.01 | 98.5 | 438 | 452 |

As can be seen from the Tables, since the use of the addition elements strengthened a dispersion strengthening function and suppressed the grain growth of the tungsten crystals, the enhancement of the strength was observed.

Examples 11A to 25A, Comparative Examples 11-1A to 11-2A, and Comparative Example 12

The emission characteristics of discharge lamp electrode parts of Examples 11 to 25, Comparative Example 11-1, and Comparative Example 11-2 were investigated. For the measurement of the emission characteristics, emission current densities ($mA/mm^2$) were measured by changing an applied voltage (V) to 100 V, 200 V, 300 V, and 400 V. The emission current densities were measured under conditions of an electric current load of 18±0.5 A/W applied to the discharge lamp electrode part and an application time of 20 ms.

A discharge lamp electrode part which was made of a tungsten alloy containing 2 wt % of $ThO_2$ and had a wire diameter of 8 mm was prepared as Comparative Example 12. The results are shown in Table 13.

TABLE 13

| | | Emission current density ($mA/mm^2$) | | | |
|---|---|---|---|---|---|
| | Electrode part | Applied voltage 100 V | Applied voltage 200 V | Applied voltage 300 V | Applied voltage 400 V |
| Example 11A | Example 11 | 1.8 | 32.5 | 44.5 | 47.0 |
| Example 12A | Example 12 | 2.0 | 33.7 | 45.9 | 49.2 |
| Example 13A | Example 13 | 2.3 | 35.3 | 46.7 | 50.3 |
| Example 14A | Example 14 | 2.4 | 38.5 | 50.0 | 52.2 |
| Example 15A | Example 15 | 2.4 | 39.7 | 51.5 | 54.1 |
| Example 16A | Example 16 | 2.3 | 34.5 | 47.5 | 49.7 |
| Example 17A | Example 17 | 2.3 | 35.8 | 48.6 | 49.8 |
| Example 18A | Example 18 | 2.0 | 33.2 | 45.7 | 48.7 |
| Example 19A | Example 19 | 2.0 | 33.9 | 46.8 | 50.0 |
| Example 20A | Example 20 | 2.0 | 33.8 | 47.4 | 50.2 |

TABLE 13-continued

| | | Emission current density ($mA/mm^2$) | | | |
|---|---|---|---|---|---|
| | Electrode part | Applied voltage 100 V | Applied voltage 200 V | Applied voltage 300 V | Applied voltage 400 V |
| Example 21A | Example 21 | 2.0 | 33.8 | 46.0 | 49.4 |
| Example 22A | Example 22 | 2.0 | 33.8 | 46.1 | 49.4 |
| Example 23A | Example 23 | 2.0 | 33.9 | 46.1 | 49.2 |
| Example 24A | Example 24 | 2.0 | 34.0 | 46.5 | 49.3 |
| Example 25A | Example 25 | 2.0 | 33.8 | 46.4 | 49.5 |
| Comparative Example 11-1A | Comparative Example 11-1 | 2.3 | 36.1 | 47.0 | 50.1 |
| Comparative Example 11-2A | Comparative Example 11-2 | 2.3 | 33.4 | 42.4 | 44.7 |
| Comparative Example 12A | Comparative Example 12 | 1.1 | 31.1 | 43.0 | 45.0 |

The discharge lamp electrode parts according to Examples exhibited emission characteristics equal to or higher than those of Comparative Example 12 using thorium oxide in spite of the nonuse of thorium oxide. The temperatures of the cathode parts were 2100 to 2200° C. during measurement. For this reason, the cathode parts according to Examples have excellent strength at a high-temperature.

Examples 26 to 28

Next, there were prepared Example 26 (the recrystallization heat treatment condition of Example 11 was changed to 1800° C.), Example 27 (the recrystallization heat treatment condition of Example 13 was changed to 1800° C.), and Example 28 (the recrystallization heat treatment condition of Example 18 was changed to 1800° C.) produced by the same production method except that the recrystallization heat treatment condition was changed to 1800° C. in the discharge lamp electrodes of Example 11, Example 13, and Example 18. The same measurement was performed. The results are shown in Tables 14 and 15.

TABLE 14

| | Tungsten crystal particle diameter | | | | | | ZrC particles | | |
|---|---|---|---|---|---|---|---|---|---|
| | Transverse section | | | Vertical section | | | Average | | |
| | Ratio of 1 to 80 μm(%) | Average particle diameter (μm) | Average aspect ratio | Ratio of 2 to 120 μm(%) | Average particle diameter (μm) | Average aspect ratio | particle diameter of primary particles (μm) | Maximum diameter of primary particles (μm) | Maximum diameter of secondary particles (μm) |
| Example 26 | 100 | 15.6 | 2.9 | 100 | 20.1 | 4.4 | 1.2 | 2.6 | 7.0 |
| Example 27 | 98 | 36.5 | 2.8 | 97 | 47.1 | 3.9 | 4.5 | 7.0 | 10.0 |
| Example 28 | 100 | 26.8 | 2.5 | 100 | 33.8 | 4.2 | 0.7 | 1.7 | 3.2 |

TABLE 15

| | x value when expressed in $ZrC_x$ | Parts by mass of Zr contained in ZrC when the total amount of Zr is defined as 100 parts by mass | Oxygen content in tungsten alloy (wt %) | Relative density (%) | Vickers hardness (Hv) | Three point bending strength (MPa) |
|---|---|---|---|---|---|---|
| Example 26 | 0.67 | 67 | 0.06 | 99.1 | 480 | 493 |
| Example 27 | 0.39 | 39 | <0.01 | 96.3 | 422 | 450 |
| Example 28 | 0.60 | 60 | <0.01 | 99.3 | 491 | 494 |

The discharge lamp electrode parts according to the Examples had high density, an excellent Vickers hardness (Hv), and an excellent three point bending strength. This was because a part of ZrC was decarbonized. As a result of analyzing the Zr component which was not contained into ZrC, the Zr component became a solid solution of tungsten and zirconium. That is, two kinds (Zr and ZrC) existed as the Zr component. For this reason, when the recrystallization heat treatment temperature is set to 1700° C. or more, metal Zr is found to be likely to be solid-solved in tungsten. The emission characteristics were measured by the same method. The results are shown in Table 16.

TABLE 16

| | | Emission current density (mA/mm$^2$) | | | |
|---|---|---|---|---|---|
| | Electrode part | Applied voltage 100 V | Applied voltage 200 V | Applied voltage 300 V | Applied voltage 400 V |
| Example 26A | Example 26 | 2.0 | 34.2 | 46.1 | 49.2 |
| Example 27A | Example 27 | 2.6 | 36.8 | 48.0 | 52.5 |
| Example 28A | Example 28 | 2.3 | 35.8 | 46.7 | 50.6 |

It was found that metal Zr is wholly solid-solved in tungsten as described above, which improves the emission characteristics. This is considered to be because the existence of metal Zr on the surface of the tungsten alloy is likely to be caused by the solid solution.

Since the present embodiments have excellent emission characteristics as described above, the present embodiments can be used for not only the discharge lamp electrode part but also fields such as the magnetron part (coil part) and the transmitting tube part (mesh grid) requiring the emission characteristics.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A tungsten alloy part used for a discharge lamp part, a transmitting tube part, or a magnetron part, the tungsten alloy part comprising tungsten and 0.1 to 5 wt % Zr in terms of ZrC, wherein contents of Zr, ZrC and C are expressed as $ZrC_x$ where $0<x<1$, and wherein the tungsten alloy part satisfies C1<C2, where C1 is an amount of carbon in a surface part of the tungsten alloy part, and C2 is an amount of carbon in a central part of the tungsten alloy part, and units of C1 and C2 are wt %.

2. A discharge lamp comprising the tungsten alloy part according to claim 1.

3. A transmitting tube comprising the tungsten alloy part according to claim 1.

4. A magnetron comprising the tungsten alloy part according to claim 1.

5. The tungsten alloy part according to claim 1, wherein a value of C1/C2 falls within a range from 0.40/0.55 to 0.57/0.65.

* * * * *